US008192446B2

(12) United States Patent
Mueller

(10) Patent No.: US 8,192,446 B2
(45) **Date of Patent: *Jun. 5, 2012**

(54) HAIR REMOVAL APPARATUS AND METHOD

(76) Inventor: Michael Mueller, Crystal River, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/914,187

(22) Filed: Oct. 28, 2010

(65) Prior Publication Data

US 2011/0295275 A1 Dec. 1, 2011

Related U.S. Application Data

(63) Continuation-in-part of application No. 12/791,185, filed on Jun. 1, 2010.

(51) Int. Cl.
*A61B 17/50* (2006.01)

(52) U.S. Cl. ..... 606/133

(58) Field of Classification Search ..... 606/131, 606/133, 43; 132/212, 200, 214, 323
See application file for complete search history.

(56) References Cited

U.S. PATENT DOCUMENTS

| | | | | |
|---|---|---|---|---|
| 4,750,771 | A | 6/1988 | Emmett | |
| 5,908,425 | A | 6/1999 | Adam | |
| 5,951,573 | A * | 9/1999 | Yashar | 606/133 |
| 2008/0287964 | A1 | 11/2008 | Sun et al. | |
| 2009/0030430 | A1 | 1/2009 | Levi | |

* cited by examiner

*Primary Examiner* — Tuan V Nguyen
(74) *Attorney, Agent, or Firm* — FSB Fisher Broyles, LLP; Anthony J. Dovale

(57) ABSTRACT

A hair removal apparatus and method is presented. The hair removal apparatus can have a pair of tension units and at least one hair removal line. In one aspect, each of the tension units can have a first arm and a second arm that is moveable in relation to the first arm such that the distance between the distal ends of the two arms can be changed with respect to one another. In one aspect of the hair removal method, the line is configured to form an "X," with the center of the "X" being the twist point. The hair is removed by moving the twist point past the target hair, catching the target hair in a portion of the twist point, removing it from the skin.

18 Claims, 6 Drawing Sheets

HAIR REMOVAL APPARATUS AND METHOD

This application claims priority to and is a continuation-in-part of application Ser. No. 12/791,185, filed Jun. 1, 2010, which is incorporated in its entirety in this document by reference.

FIELD OF THE INVENTION

Presented herein is a hair removal apparatus and method. In particular, a hair removal apparatus and method for personal grooming is presented.

BACKGROUND OF THE INVENTION

The personal grooming market is a large segment of the American economy. Women, in particular, spend millions of dollars each year nation-wide to look beautiful. Hair removal on the legs and eyebrows is very popular around the world and many apparatuses and procedures have been developed therefore.

Currently, waxing and tweezing of eyebrows are the predominant methods of hair removal. However, eyebrow threading is becoming more popular. Eyebrow threading originally began in China, although the technique has populated to South East Asia, India and most recently, California. While China has been known for this popular threading technique, it wasn't until India introduced it to the United States that it took hold.

Eyebrow Threading allows you to shape the brow by removing hair by the follicle while leaving behind a clean line. The threading involves twisting a piece of cotton thread and rolling it along the surface of the skin to pick up a single line of hairs, which are then lifted out from the follicle. The threading is generally done by starting at the center area of the brows and then working towards the top and bottom of the brow. The results typically last 2-3 weeks, but after repeated threading they can last anywhere from 4-6 weeks.

Threading is less painful than tweezing, lasts longer and won't leave skin irritated, unlike waxing. Eyebrow threading is only best however, for those who have a lot of eyebrow hair or a unibrow that they want to remove without the bother of a time consuming method like tweezing. And, the great thing about eyebrow threading is that it isn't just for the eyebrows. Threading can be done on other parts of the face or body where hair is unwanted. You can have this technique done on places like the upper lip or even your legs, which has been favored by women in countries like Korea and Vietnam.

Unfortunately, eyebrow threading is not as easy as it sounds and it's generally best left to a professional. Trying this technique at home can result in uneven brows or hair breakage if you're not familiar with the steps used.

SUMMARY

Presented herein is a hair removal apparatus and method. The hair removal apparatus comprises a pair of tension units and at least one hair removal line.

In one aspect, each of the tension units comprises a first arm and a second arm that is moveable in relation to the first arm such that the distance between the distal ends of the two arms can be changed with respect to one another. In a first position the distal ends of the two arms are substantially adjacent one another, and in a second position, the distal ends of the two arms are spaced apart.

The hair removal line can be configured in a complete loop, or in another example, the hair removal line can be two discrete lines, each connected at one end to respective distal ends of the two arms of one tension unit, and to respective distal ends of the two arms of a second tension unit.

Also presented is a method of using the hair removal apparatus. In one aspect, the line is threaded through the apertures on the distal ends and joined together to form the loop. In one aspect, a free end of the hair removal line is knotted with another portion of the hair removal line. The next step is forming a twist point with the hair removal line by twisting one or both of the tension units about the centerline of the tension unit(s). The result of this step is that the line substantially forms an "X," with the center of the "X" being the twist point.

The next step comprises the step of pulling the hair removal line taught and moving the twist point to one side of the center between the tension units by opening proximal ends of the first tension unit, causing the distal ends of the first tension unit to be in the first position. At this point, the hair removal line can be place in contact with the skin, putting the target hair adjacent the twist point and between the twist point and the second tension unit.

The hair is removed by moving the twist point past the target hair, catching the target hair in a portion of the twist point, removing it from the skin.

DETAILED DESCRIPTION OF THE DRAWINGS

The accompanying drawings, which are incorporated in and constitute a part of this specification, illustrate several aspects of the invention and together with the description, serve to explain the principles of the invention.

DETAILED DESCRIPTION OF THE INVENTION

Figure 1:
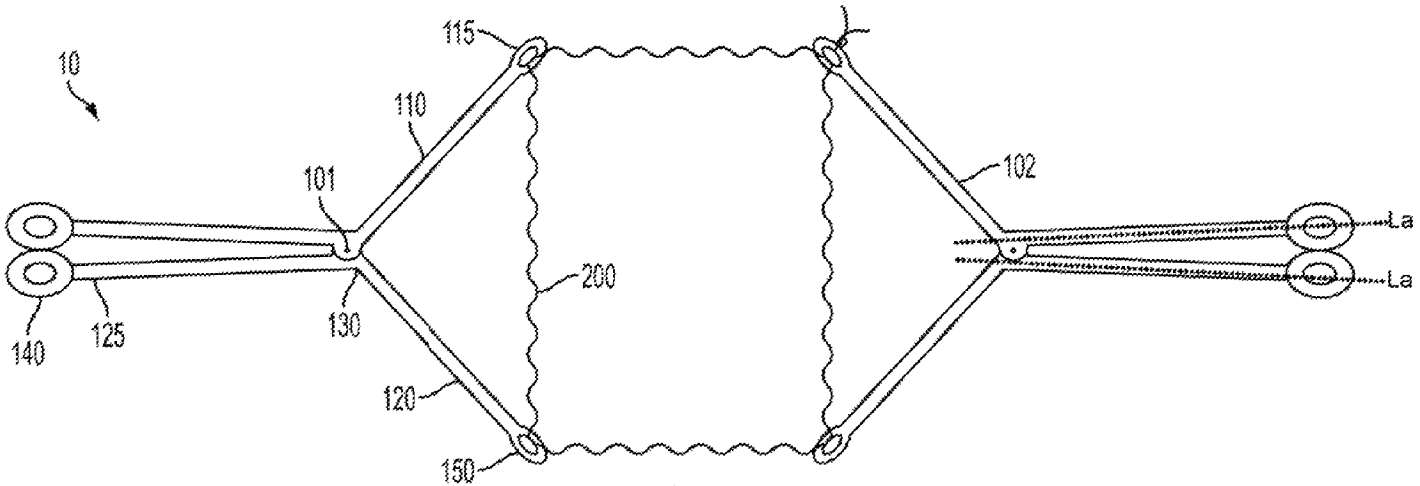
FIG. 1 is a side elevational view of one aspect of the hair removal apparatus and the first step of the hair removal method, showing the distal ends of the arms of the tension units in the second position.

The present invention is more particularly described in the following exemplary aspects that are intended as illustrative only since numerous modifications and variations therein will be apparent to those skilled in the art. The exemplary aspects are now described with reference to the figures, in which like reference characters indicate like parts throughout the several views.

Before the present articles, compositions, devices, and/or methods are disclosed and described, it is to be understood that this invention is not limited to the specific articles, devices, and/or methods disclosed unless otherwise specified, as such may, of course, vary. It is also to be understood that the terminology used herein is for the purpose of describing particular aspects only and is not intended to be limiting.

As used herein, the singular forms "a," "an" and "the" include plural referents unless the context clearly dictates otherwise. Thus, for example, reference to "a thread" includes aspects having two or more such threads unless the context clearly indicates otherwise.

Presented herein is a hair removal apparatus and method for removing target hair from a human subject. The hair removal apparatus 10 comprises a pair of tension units 100 and at least one hair removal line 200.

In one aspect, each of the tension units 100 comprises a first arm 110 and a second arm 120 that is moveable in relation to the first arm 110 such that the distance between the distal ends 115 of the two arms can be changed with respect to one another. In a first position the distal ends 115 of the two arms are substantially adjacent one another, and in a second position, the distal ends of the two arms are spaced apart. In one aspect, the two arms are hingedly connected, such that a center portion 130 of the two arms are connected and the arms are configured to scissor open and closed, as in FIG. 1. The tension units 100 can, for example and not meant to be limiting, comprise metal, plastic, alloy, ceramic, or other sufficiently rigid materials known in the art.

In one example, the first arm and the second arm of the tension unit is hingedly connected at a middle portion of the respective first and second arms. The hinge can, for example, be substantially mid-way between the distal and proximal ends, or it can be more toward the either the distal or proximal ends. In another aspect, the proximal ends 125 of the arms of the tension unit 100 each define a finger or thumb hole 140. The finger or thumb holes can be the same size or they can be varied in size to accommodate a finger and a thumb, respectively, as can be appreciated.

As can be seen in FIG. 1, in one aspect, each arm can comprise a distal end that diverges from the centerline $C_L$ of the tension unit 100, where the distal end of each arm is angled with respect to the arm's longitudinal axis $L_a$. In this aspect, when the proximal ends 125 of the arms are adjacent one another, the distal ends 115 of the arms in the second position; and, when the proximal ends of the arms are spaced from one another, the distal ends of the arms converge toward each other to the first position.

In one example of the apparatus 10, at least one of the distal ends of the arms of the tension unit defines an aperture 150 through which a hair removal line 200 may be threaded. As one can appreciate, the distal ends of the arms of the tension unit may also comprise hooks or other line retention modalities.

The hair removal line 200 can be configured in a complete loop, as in FIG. 1, or in another example, the hair removal line can be two discrete lines, each connected at one end to respective distal ends of the two arms of a first tension unit 101, and to respective distal ends of the two arms of a second tension unit 102. In one aspect, the hair removal line can comprise cotton thread, monofilament line, wire, and the like.

FIGS. 1-6 illustrate one aspect of a method of using the device described herein. FIG. 1 shows a continuous hair removal line 200 connected to distal ends of each of the arms of two tension units to form a complete loop. In one aspect, the line is threaded through the apertures on the distal ends and joined together to form the loop, as illustrated. In one aspect, the line is approximately 10-20 inches long, although other lengths are contemplated. In another aspect, the line is approximately 15 inches long.

Figure 2:
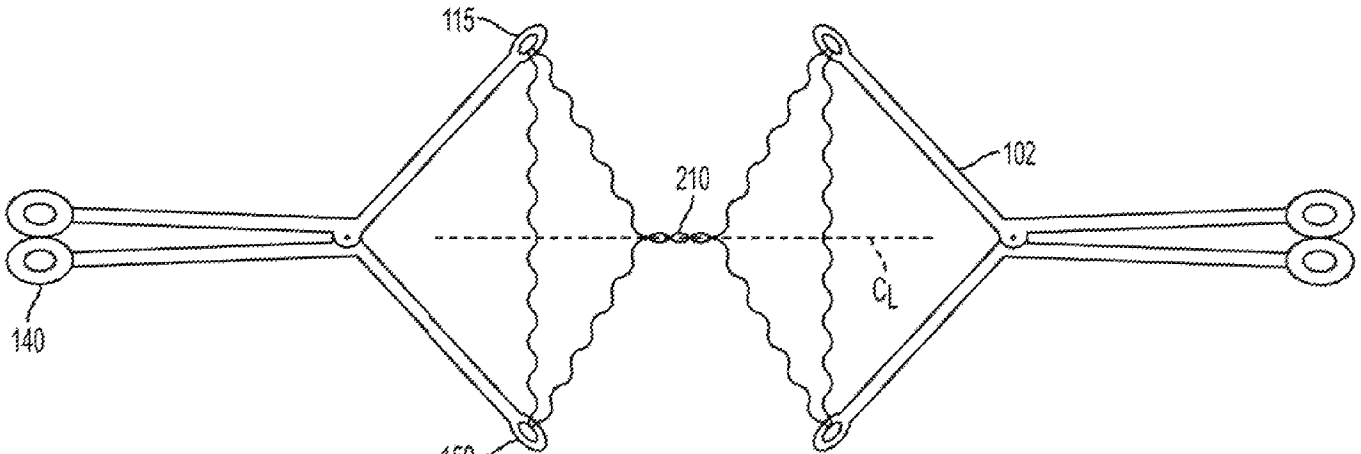
FIG. 2 is a side elevational view of one aspect of a step of the hair removal method of FIG. 1, showing the formation of a twist point.
Figure 3:
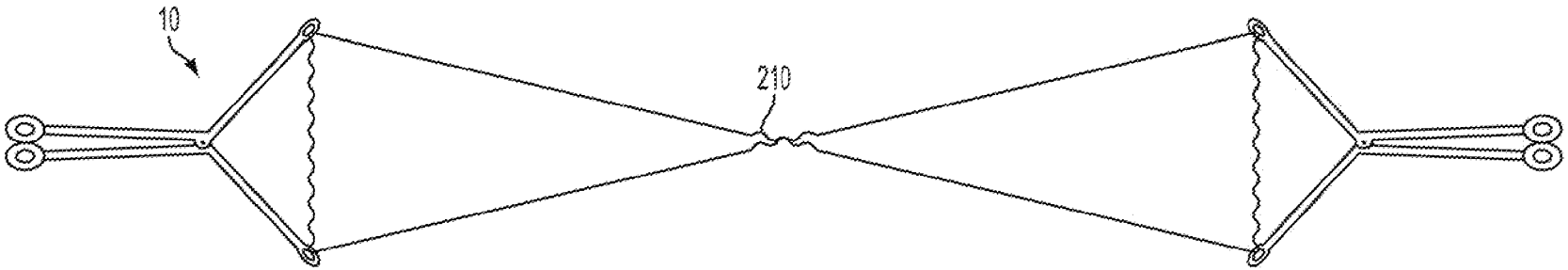
FIG. 3 is a side elevational view of one aspect of a step of the hair removal method of FIG. 1, showing the hair removal line being pulled taught and substantially forming an "X"

FIG. 2 shows the step of forming a twist point 210 with the hair removal line 200 by twisting one or both of the tension units about the center line of the tension unit(s). Of course, if both tension units are twisted, they should be twisted in an opposite direction so as to form the requisite twist point. In one aspect, the tension unit is twisted 4-20 times. In another aspect, the tension unit is twisted 7-15 times. In yet another aspect, the tension unit is twisted 10 times. FIG. 3 shows the result, which is that the hair removal line substantially forms an "X," with the center of the "X" being the twist point.

Figure 4:
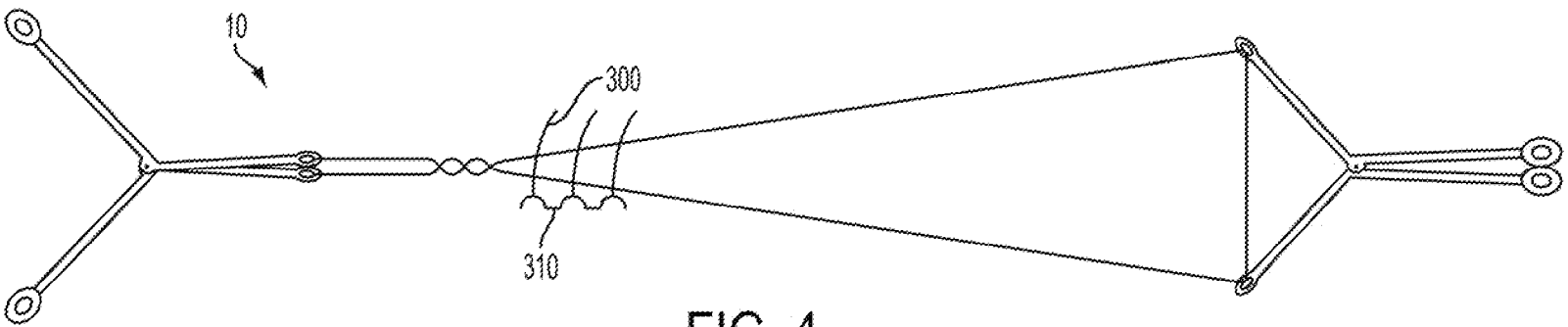
FIG. 4 is a side elevational view of one aspect of a step of the hair removal method of FIG. 1, showing the twist point to one side of the center between the tension units by opening proximal ends of the first tension unit, causing the distal ends of the first tension unit to be in the first position.

FIG. 4 shows the step of pulling the hair removal line taught and moving the twist point to one side of the center between the tension units by opening proximal ends of the first tension unit, causing the distal ends of the first and second arms of the first tension unit 101 to be in the first position. At this point, the hair removal line can be place in contact with the skin 310, putting the target hair 300 adjacent the twist point and between the twist point and the second tension unit.

Figure 5:
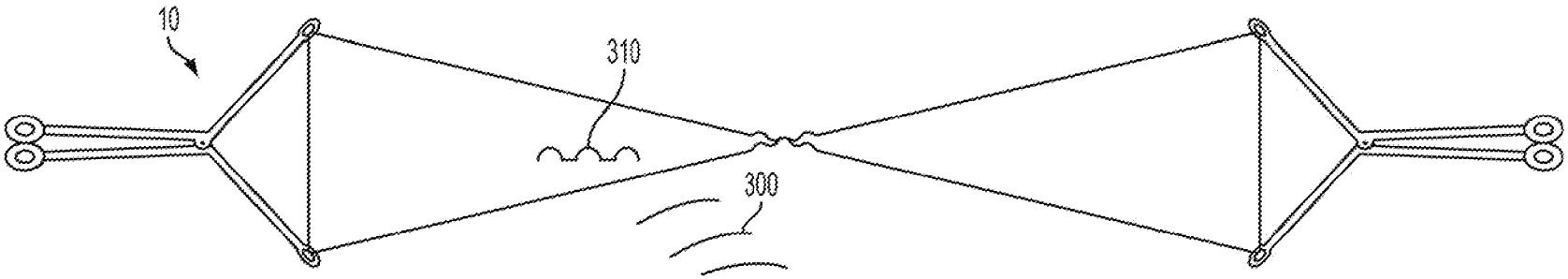
FIG. 5 is a side elevational view of one aspect of a step of the hair removal method of FIG. 1, showing the step of moving the twist point past the target hair and removing it.

FIG. 5 displays the step of removing the target hair 300 by closing the proximal ends of the first and second arms of the first tension unit, causing the distal ends of the first and second arms of the first tension unit to open to the second position and the twist point to move toward the second tension unit. As the twist point moves past the target hair, the target hair gets caught in a portion of the twist point, removing it from the skin. As can be appreciated, the twist point can be moved in either direction by manipulating the space between the distal ends of either the first or second tension unit, or both. This process can be repeated as many times as the user wishes.

Figure 6:
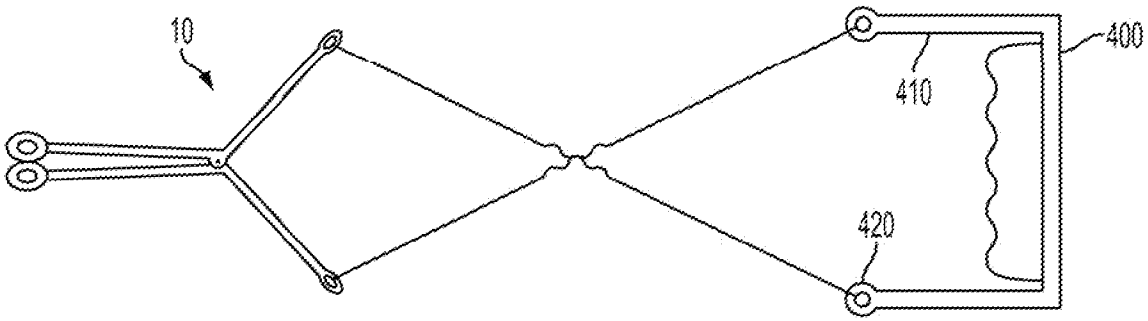
FIG. 6 is a side elevational view of one aspect of the hair removal apparatus, illustrating a hair removal line holder being utilized in lieu of the second tension unit.

FIG. 6 illustrates another example of the foregoing method by replacing the second tension unit with a hair removal line holder 400. The hair removal line holder comprises two substantially stationary arms 410 configured to hold portions of the line. In this aspect, the first tension unit solely moves the twist point back and forth. As can be appreciated, the distal ends 420 of each of the substantially stationary arms can comprise apertures, hooks, or other line retention means.

It is also contemplated that the method can be performed using a single tension unit, while holding the removal line without the use of an apparatus. For example, the user may use his or her mouth, hand, fingers, and the like to hold portions of the removal line while using the single tension unit to manipulate the position of the twist point.

Figure 7:
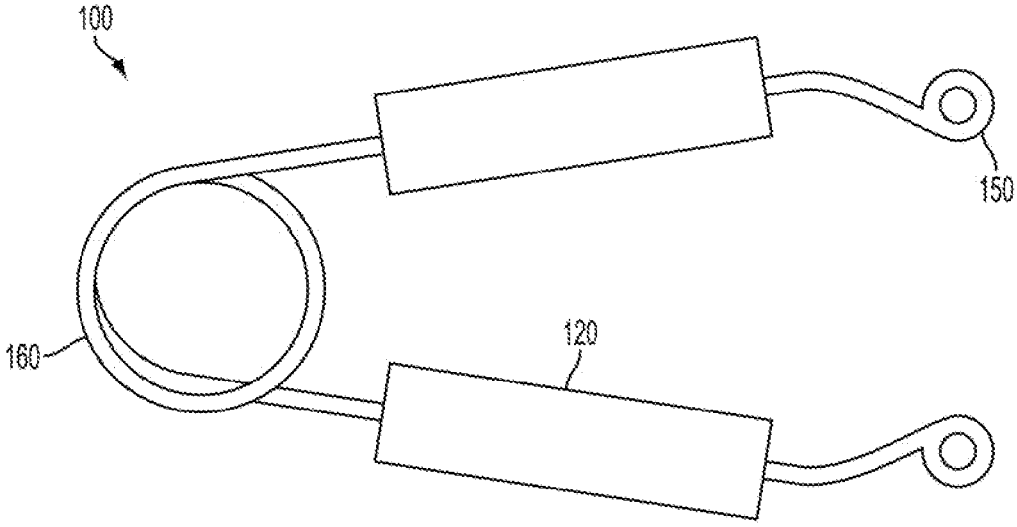
FIG. 7 is a side elevational view of one aspect of the hair removal apparatus having a coil as a bias element.
Figure 9:
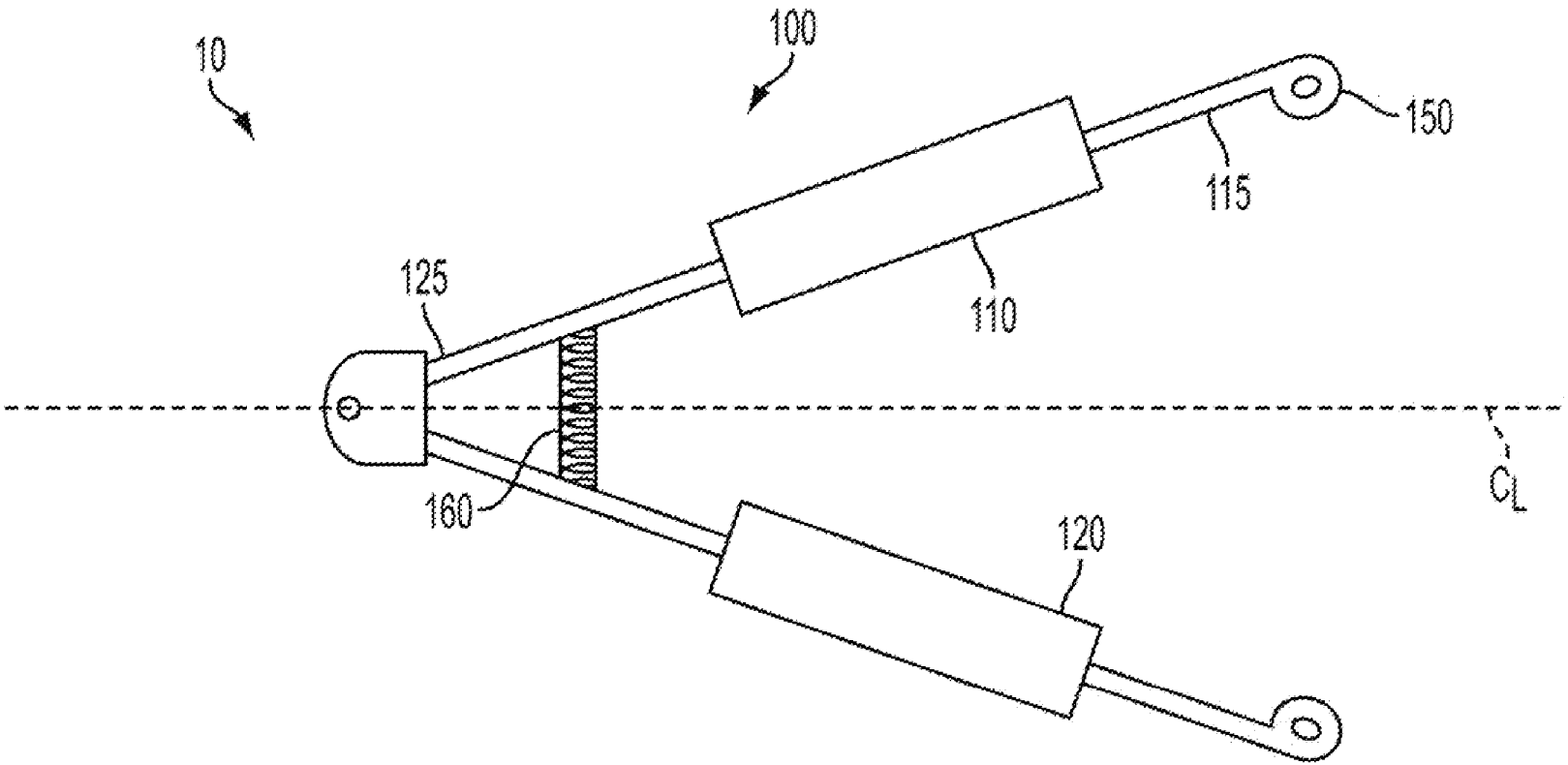
FIG. 9 is a side elevational view of one aspect of the hair removal apparatus having a bias element between the two arms.

In another aspect, the tension unit comprises two arms with spaced distal ends and proximal ends that are connected. In another aspect, the tension unit comprises a bias element 160 configured to assist keeping the two arms in the second position. Examples of this aspect, which are not meant to be limiting, are illustrated in FIGS. 7 and 9. In yet another aspect, the tension unit's arms are connected such that the bias element comprises a coil that acts like a spring, as can be seen in FIG. 7.

Figure 8:
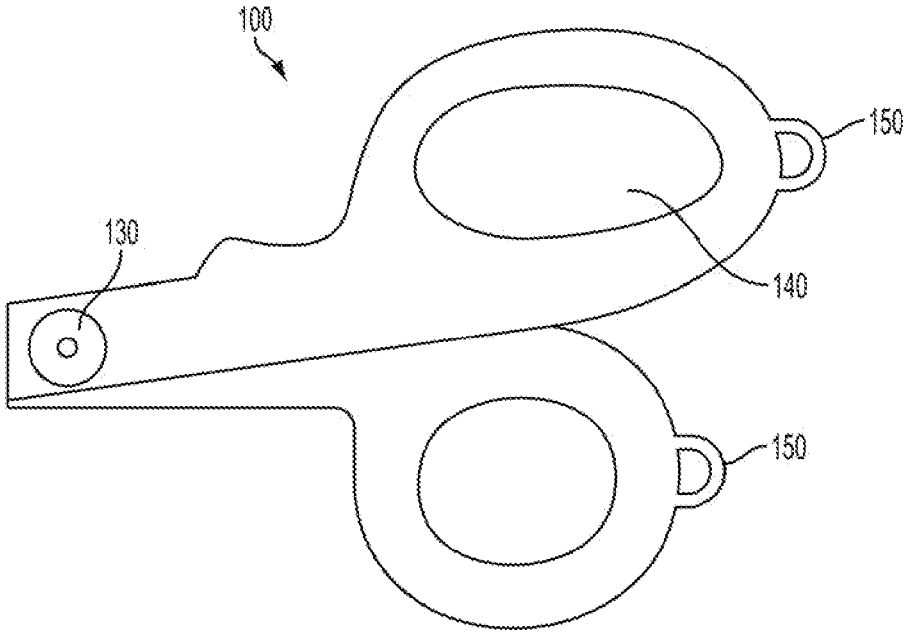
FIG. 8 is a side elevational view of one aspect of the hair removal apparatus having substantially linear arms.

In one example, the tension unit comprises two substantially linear arms hingedly joined in a center portion, such as a common household scissor. In this aspect, the distal ends are in the first position when the proximal ends are substantially adjacent each other; and, the distal ends are in the second position when the proximal ends are spaced from each other. This aspect is illustrated in FIG. 8.

Figure 10:
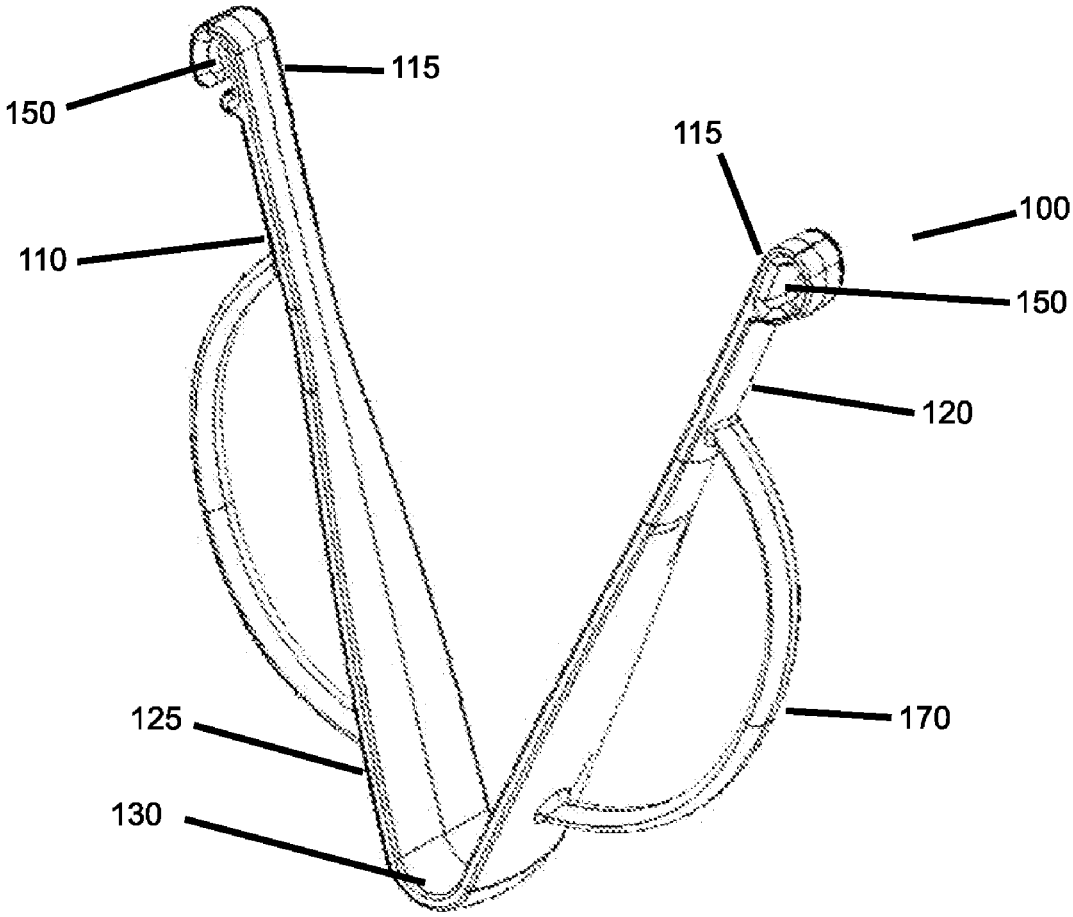
FIG. 10 is a perspective view of one aspect of a hair removal apparatus having two integral arms.

In one exemplified aspect, as illustrated in FIG. 10, the tension unit may comprise two arms 110, 120 joined at the proximal end 125. The joinder of the arms can be a hinged connection, in one aspect. In another aspect, the two arms are part of an integral apparatus whereby the materials of construction make the unit sufficiently rigid to hold their form, while at the same time, are resiliently deformable. As such, a user can compress the two arms to a first position in which the arms are substantially adjacent each other. When the user releases the compression, the arms will naturally bias back to their original relaxed state in which the two arms are in spaced relation. The apparatus, in one aspect, also can comprise stabilizers 170 to increase the rigidity of the arms. In one aspect, the apparatus comprises polycarbonate, polypropylene, high density polyethylene, acetyl, ABS, nylon 66, polystyrene, or the like. However, other resiliently deformable, substantially rigid materials are contemplated.

Although several aspects of the invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described invention.

The invention claimed is:

1. A hair removal apparatus comprising:

a tension unit comprising a first arm and a second arm connected to the first arm, the first arm and second arm having proximal and distal ends, wherein the distal ends of the first and second arms are configured to move from a first position, where the distal ends of the first and second arms are substantially adjacent each other, to a second position, where the distal ends of the first and second arms are spaced from each other;

at least one hair removal line, wherein a first portion of the at least one hair removal line is connected to a portion of the distal end of the first arm and a second portion of the at least one hair removal line is connected to a portion of the distal end of the second arm, and wherein the at least one hair removal line defines a first line segment and a second line segment; and a means for holding a third and fourth portion of the at least one hair removal line in a spaced relation, wherein the first line segment spans between the distal end of the first arm and the means for holding, and the second line segment spans between the distal end of the second arm and the means for holding.

2. The hair removal apparatus of claim 1, wherein the first arm and the second arm are connected substantially adjacent the proximal ends of the respective first and second arms.

3. The hair removal apparatus of claim 2, wherein the first and second arms are integral.

4. The hair removal apparatus of claim 3, wherein the tension unit comprises a resiliently deformable material whereby the first arm and the second arm are configured to bias from a first compressed position in which the distal ends are substantially adjacent each other, to a second relaxed position in which the distal ends are in a spaced relation.

5. The hair removal apparatus of claim 4, wherein the resiliently deformable material comprises polypropylene.

6. The hair removal apparatus of claim 1, wherein the means for holding the third and fourth portions of the at least one hair removal line comprises a hair removal line holder comprising a first fixed arm and a second fixed arm, whereby the first portion of the at least one hair removal line is connected to a distal portion of the first fixed arm, and the second portion of the at least one hair removal line is connected to a distal portion of the second fixed arm.

7. The hair removal apparatus of claim 1, wherein the means for holding the third and fourth portions of the at least one hair removal line comprises a second tension unit.

8. The hair removal apparatus of claim 1, wherein the first arm and the second arm are connected at a middle portion of the respective first and second arms.

9. The hair removal apparatus of claim 8, wherein the proximal end of the first arm defines a finger loop.

10. The hair removal apparatus of claim 7, wherein the proximal end of the second arm defines a finger loop.

11. The hair removal apparatus of claim 8, wherein the distal end of the first arm is angled with respect to a longitudinal axis of the first arm in a direction away from a centerline of the tension unit.

12. The hair removal apparatus of claim 11, wherein the distal end of the second arm is angled with respect to a longitudinal axis of the second arm in a direction away from a centerline of the tension unit.

13. The hair removal apparatus of claim 12, wherein the proximal end of the first arm is on a common side of the centerline of the tension unit as is the distal end of the first arm, and the proximal end of the second arm is on a common side of the centerline of the tension unit as the distal end of the second arm.

14. The hair removal apparatus of claim 13, wherein movement of at least one of the proximal ends of the tension unit away from the centerline of the tension unit causes the respective distal end to move into the first position, and wherein movement of at least one of the proximal ends of the tension unit toward the centerline of the tension unit causes the respective distal ends to move into the second position.

15. The hair removal apparatus of claim 1, wherein the first arm and the second arm are connected substantially adjacent the proximal ends of the respective first and second arms.

16. The hair removal apparatus of claim 15, further comprising a bias element in a center portion of the tension unit configured to bias the distal ends of the first and second arms toward the second position.

17. The hair removal apparatus of claim 1, wherein the distal ends of the first and second arms each define an aperture through which the hair removal line is connected.

18. A method of removing target hair from the skin of a human subject, comprising:

providing a hair removal apparatus, comprising:

a tension unit comprising a first arm and a second arm connected to the first arm, the first arm and second arm having proximal and distal ends, wherein the distal ends of the first and second arms are configured to move from a first position, where the distal ends of the first and second arms are substantially adjacent each other, to a second position, where the distal ends of the first and second arms are spaced from each other;

at least one hair removal line; and a means for holding at least a portion of the at least one hair removal line;

threading the hair removal line through a portion of the distal ends of each of the arms of the tension unit and through portions of the means for holding the hair removal line;

forming a loop with the hair removal line;

forming a twist point with the hair removal line by twisting the tension unit about a centerline of the tension unit;

pulling the hair removal line substantially taught;

positioning the distal ends of the first and second arms of the tension unit into the first position;

placing the twist point of the hair removal line in contact with a portion of skin adjacent the target hair such that the target hair is positioned substantially between the twist point and the means for holding at least a portion of the at least one hair removal line; and positioning the distal ends of the tension unit into the second position to move the twist point past the target hair, removing it from the skin.

* * * * *